US012203695B2

(12) United States Patent
Lee et al.

(10) Patent No.: US 12,203,695 B2
(45) Date of Patent: Jan. 21, 2025

(54) REFRIGERATOR

(71) Applicant: SAMSUNG ELECTRONICS CO., LTD., Suwon-si (KR)

(72) Inventors: Kwanyeol Lee, Suwon-si (KR); Bongsu Son, Suwon-si (KR); Minseob Yook, Suwon-si (KR); Seokjun Yoon, Suwon-si (KR); Woochul Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 229 days.

(21) Appl. No.: 17/664,625

(22) Filed: May 23, 2022

(65) Prior Publication Data

US 2022/0282904 A1 Sep. 8, 2022

Related U.S. Application Data

(63) Continuation of application No. PCT/KR2020/012880, filed on Sep. 23, 2020.

(30) Foreign Application Priority Data

Nov. 25, 2019 (KR) ..... 10-2019-0152301

(51) Int. Cl.
*F25D 23/02* (2006.01)
*F25C 5/182* (2018.01)

(52) U.S. Cl.
CPC ..... *F25D 23/028* (2013.01); *F25C 5/182* (2013.01)

(58) Field of Classification Search
CPC ..... F25D 23/028; F25D 23/04; F25C 5/182
See application file for complete search history.

(56) References Cited

U.S. PATENT DOCUMENTS

2008/0295539 A1* 12/2008 An ..... F25D 17/065 62/344
2013/0167576 A1* 7/2013 Kim ..... F25C 5/182 62/340

(Continued)

FOREIGN PATENT DOCUMENTS

KR 200129519 Y1 1/1999
KR 10-2004-0049686 A 6/2004
KR 10-0641120 B1 11/2006

(Continued)

OTHER PUBLICATIONS

International Search Report and Written Opinion of the International Searching Authority in connection with International Application No. PCT/KR2020/012880 issued Feb. 1, 2021, 13 pages.

*Primary Examiner* — Elizabeth J Martin

(57) ABSTRACT

A refrigerator includes a cabinet including a freezing compartment and a heat exchange chamber configured to supply cold air to the freezing compartment, a door configured to open and close the freezing compartment, an ice making chamber provided on a rear surface of the door and including an ice maker configured to make ice, and an ice cover configured to cover the ice maker and including a first part provided with a plurality of cold air inlet slits into which the cold air is introduced and a second part extending downward from the first part and provided with a plurality of cold air outlet slits through which the cold air is discharged.

17 Claims, 8 Drawing Sheets

(56) References Cited

U.S. PATENT DOCUMENTS

| | | | | |
|---|---|---|---|---|
| 2015/0276298 | A1 | 10/2015 | Argumedo et al. | |
| 2019/0264972 | A1* | 8/2019 | Kim | F25D 17/065 |

FOREIGN PATENT DOCUMENTS

| | | | |
|---|---|---|---|
| KR | 10-2007-0103250 | A | 10/2007 |
| KR | 10-0809749 | B1 | 3/2008 |
| KR | 10-1179732 | B1 | 9/2012 |
| KR | 10-2013-0094035 | A | 8/2013 |
| KR | 10-1376873 | B1 | 3/2014 |
| KR | 10-1540662 | B1 | 7/2015 |
| KR | 101639441 | B1 | 7/2016 |
| KR | 10-2019-0103807 | A | 9/2019 |
| KR | 10-2019-0114638 | A | 10/2019 |

* cited by examiner

REFRIGERATOR

CROSS-REFERENCE TO RELATED APPLICATIONS

This application is a bypass continuation of International Application No. PCT/KR2020/012880, filed Sep. 23, 2020, which claims priority to Korean Patent Application No. 10-2019-0152301 filed Nov. 25, 2019, the disclosures of which are herein incorporated by reference in their entirety.

BACKGROUND

1. Field

The present disclosure relates to a refrigerator provided with an ice maker.

2. Description of Related Art

A refrigerator is a home appliance for storing food in a low temperature state, and includes a refrigerating compartment capable of storing food in a refrigerated state and a freezing compartment capable of storing food in a frozen state.

Recently, a dispenser is mounted on the front of a door of the refrigerator, so that drinking water may be taken out through the dispenser without opening the door of the refrigerator.

In addition, an ice maker (ice making device) for making and storing ice may be provided inside the door of the refrigerator or a storage space and may be configured to take out ice through the dispenser.

Such an ice maker is being developed as an automatic ice maker that automatically performs water supply, ice making, and ice removal by detecting an amount of stored ice. Also, the ice stored by the automatic ice maker may be taken out through the dispenser.

Recently, due to a large amount of ice to be used, a refrigerator with an improved structure of the ice maker itself is being developed to increase a capacity of an ice bin in which the ice is stored or to make ice at a faster speed.

The present disclosure is directed to providing a refrigerator capable of improving ice making performance by promoting circulation of cold air supplied toward an ice tray.

The present disclosure is directed to providing a refrigerator in which cold air heat-exchanged while passing through an ice tray may be effectively discharged to the outside of an ice maker.

SUMMARY

An aspect of the present disclosure provides a refrigerator including a cabinet including a freezing compartment and a heat exchange chamber configured to supply cold air to the freezing compartment, a door configured to open and close the freezing compartment, an ice making chamber provided on a rear surface of the door and including an ice maker configured to make ice, and an ice cover configured to cover the ice maker and including a first part provided with a plurality of cold air inlet slits into which the cold air is introduced and a second part extending downward from the first part and provided with a plurality of cold air outlet slits through which the cold air is discharged.

The first part may further include a plurality of partition ribs configured to partition the plurality of cold air inlet slits and may be provided to be inclined downward in a direction to an inside of the freezing compartment from the door.

The second part may be provided to extend downward from a circumference of the first part.

The plurality of cold air outlet slits may be provided in a portion of the second part.

The second part may include a first side surface forming a first side of the ice cover and including a first opening, first cold air outlet slits provided in the first opening, and first ribs configured to partition the first opening to form the first cold air outlet slits, a second side surface forming the other side of the ice cover and including a second opening, second cold air outlet slits provided in the second opening, and second ribs configured to partition the second opening to form the second cold air outlet slits, and a central surface connecting the first side surface and the second side surface and including a third opening, third cold air outlet slits provided in the third opening, and third ribs configured to partition the third opening to form the third cold air outlet slits.

The first to third ribs may be injection molded into the first to third openings, respectively.

The first ribs may be provided in a portion of a lower side of the first opening, the second ribs may be provided in a portion of a lower side of the second opening, and the third ribs may be provided throughout the third opening.

The refrigerator may further include an ice bucket provided below the ice maker such that the ice made by the ice maker is dropped and stored, wherein a lower end of the ice cover may be spaced apart from an upper end of the ice bucket to form a cold air outlet through which the cold air heat-exchanged in the ice maker is discharged.

The ice maker may further include an ice tray positioned at a height corresponding to a lower end of the second part, and an upper end of the cold air outlet may be positioned at a height corresponding to a bottom surface of the ice tray.

After the cold air cools the bottom surface of the ice tray, a first part of the cold air may be discharged through the cold air outlet, and a second part of the cold air may be moved upward and discharged through the plurality of cold air outlet slits.

A sum of an area of the cold air outlet and an area of the plurality of cold air outlet slits may be greater than an area of a cold air inlet.

A guide slit opened to guide discharge of the cold air may be provided at the upper end of the ice bucket adjacent to the ice cover.

Each of the first to third ribs may include a first rib member having a hexagonal cross section, and a second rib member having a hexagonal cross section and disposed in parallel with the first rib member so that an edge of the second rib member abuts against an edge of the first rib member.

The first and second rib members may be alternately arranged along the extending direction of the second part.

Another aspect of the present disclosure provides a refrigerator including a cabinet including a freezing compartment and a heat exchange chamber configured to supply cold air to the freezing compartment, a door configured to open and close the freezing compartment, an ice making chamber provided on a rear surface of the door and including an ice maker configured to make ice, an ice cover configured to cover the ice maker and including a first part provided with a plurality of cold air inlet slits into which the cold air is introduced and a second part extending downward from the first part and provided with a plurality of cold air outlet slits through which the cold air is discharged, and an ice bucket provided such that the ice made by the ice maker is dropped and stored and provided with a guide slit opened to guide discharge of the cold air at an upper end thereof.

A refrigerator according to the present disclosure can promote circulation of cold air by providing a plurality of cold air discharge holes through which cold air is discharged on a lower cover of an ice cover.

In addition, the refrigerator according to the present disclosure can improve an ice-making speed in an ice tray, thereby improving the ice-making performance of an ice maker.

Before undertaking the detailed description below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like;

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
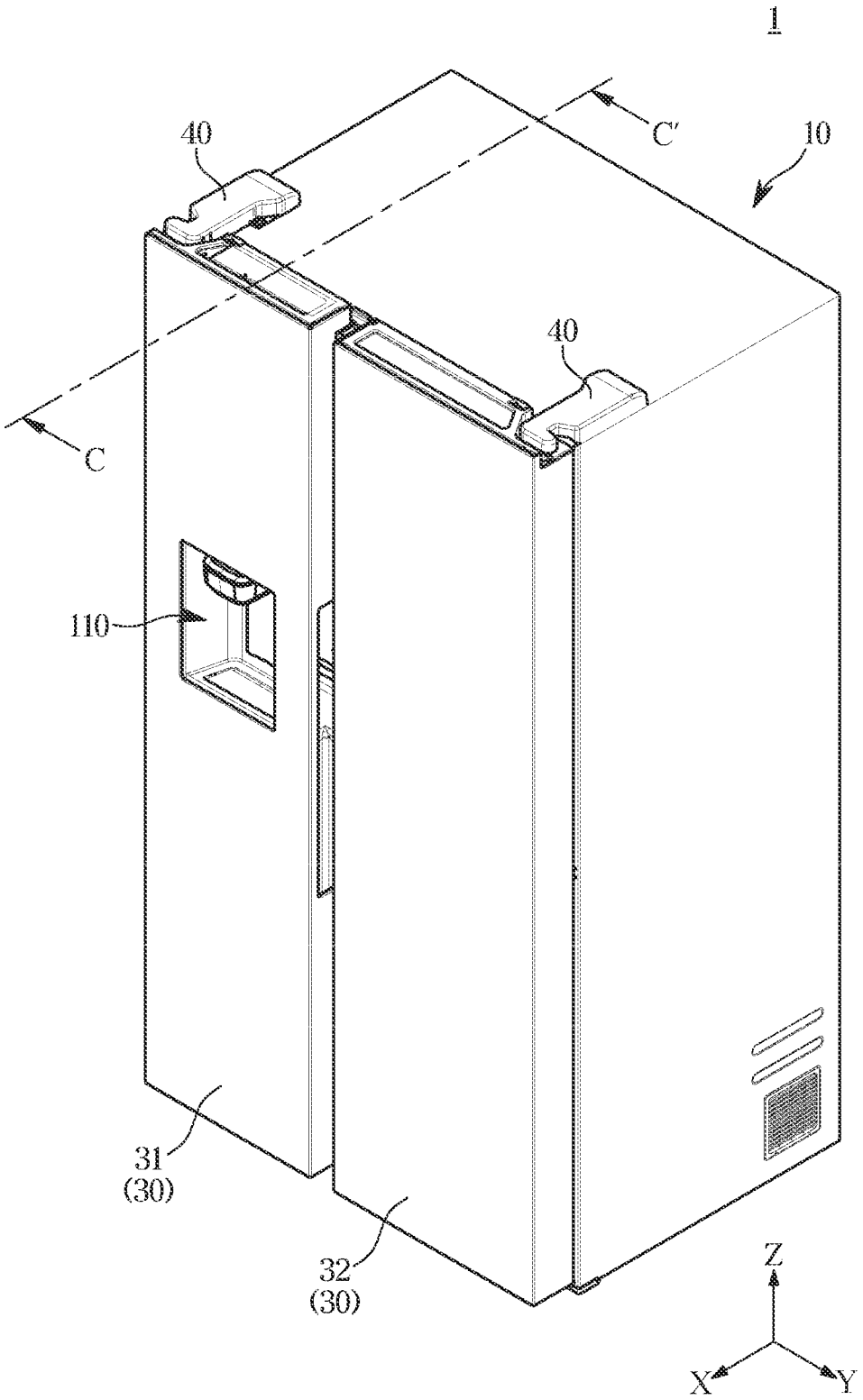
FIG. 1 is a perspective view of a refrigerator according to various embodiments of the present disclosure.

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

Figure 2:
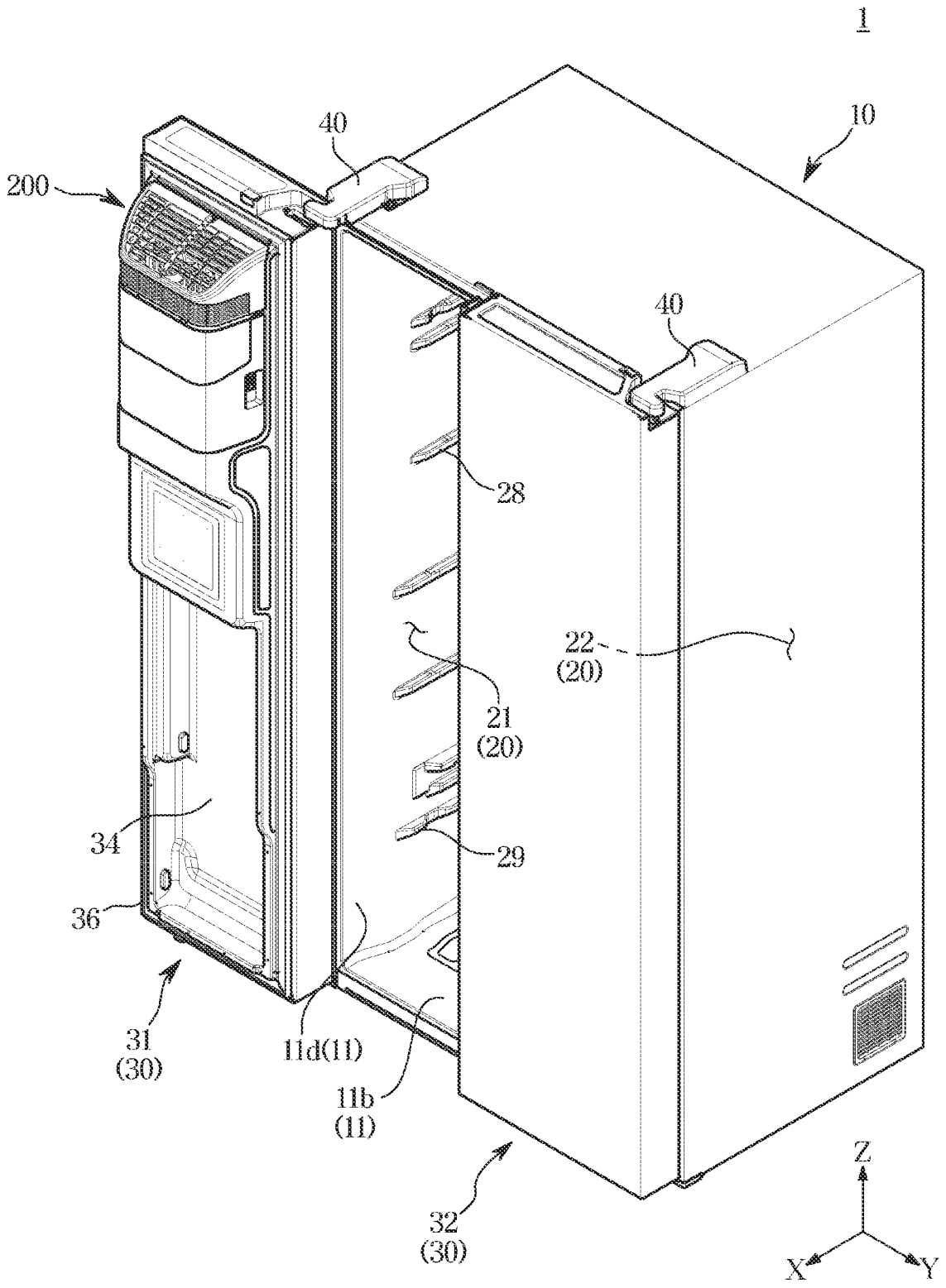
FIG. 2 is a view illustrating a state in which a freezing compartment door is opened in the refrigerator according to various embodiments of the present disclosure.
Figure 3:
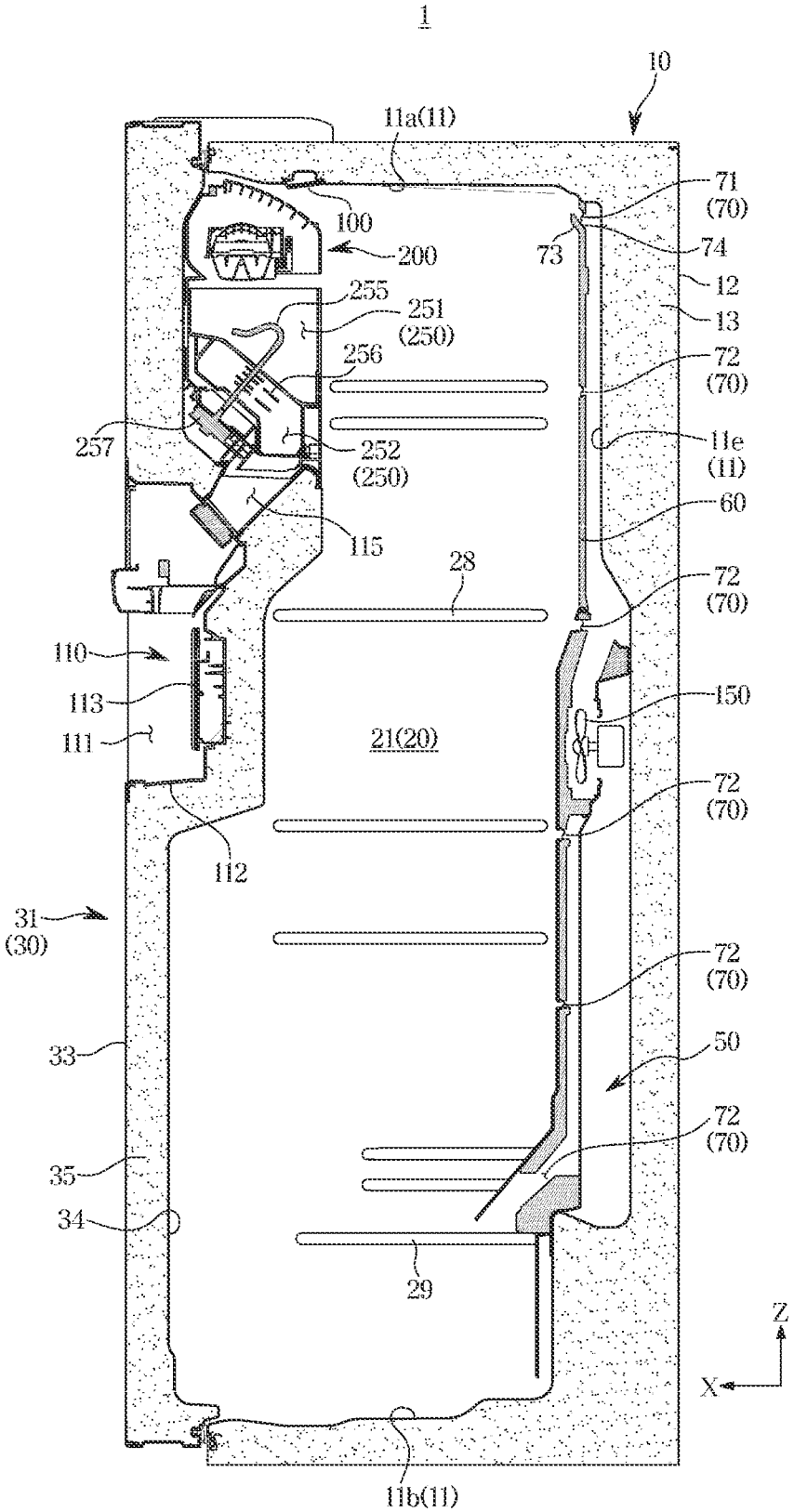
FIG. 3 is a cross-sectional view of the refrigerator taken along line C-C' in FIG. 1.
Figure 4:
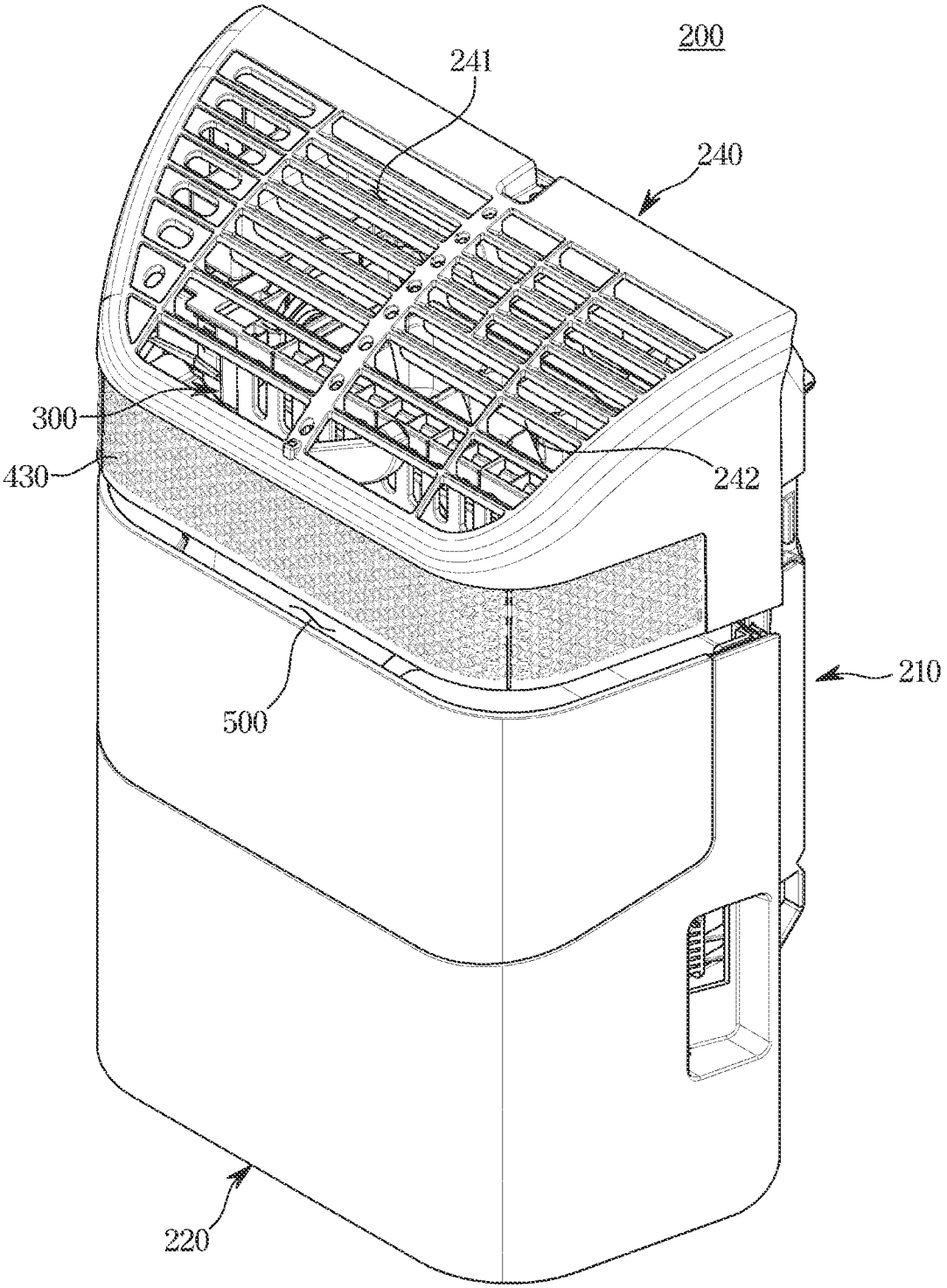
FIG. 4 is a perspective view illustrating an ice making chamber in the refrigerator according to various embodiments of the present disclosure.
Figure 5:
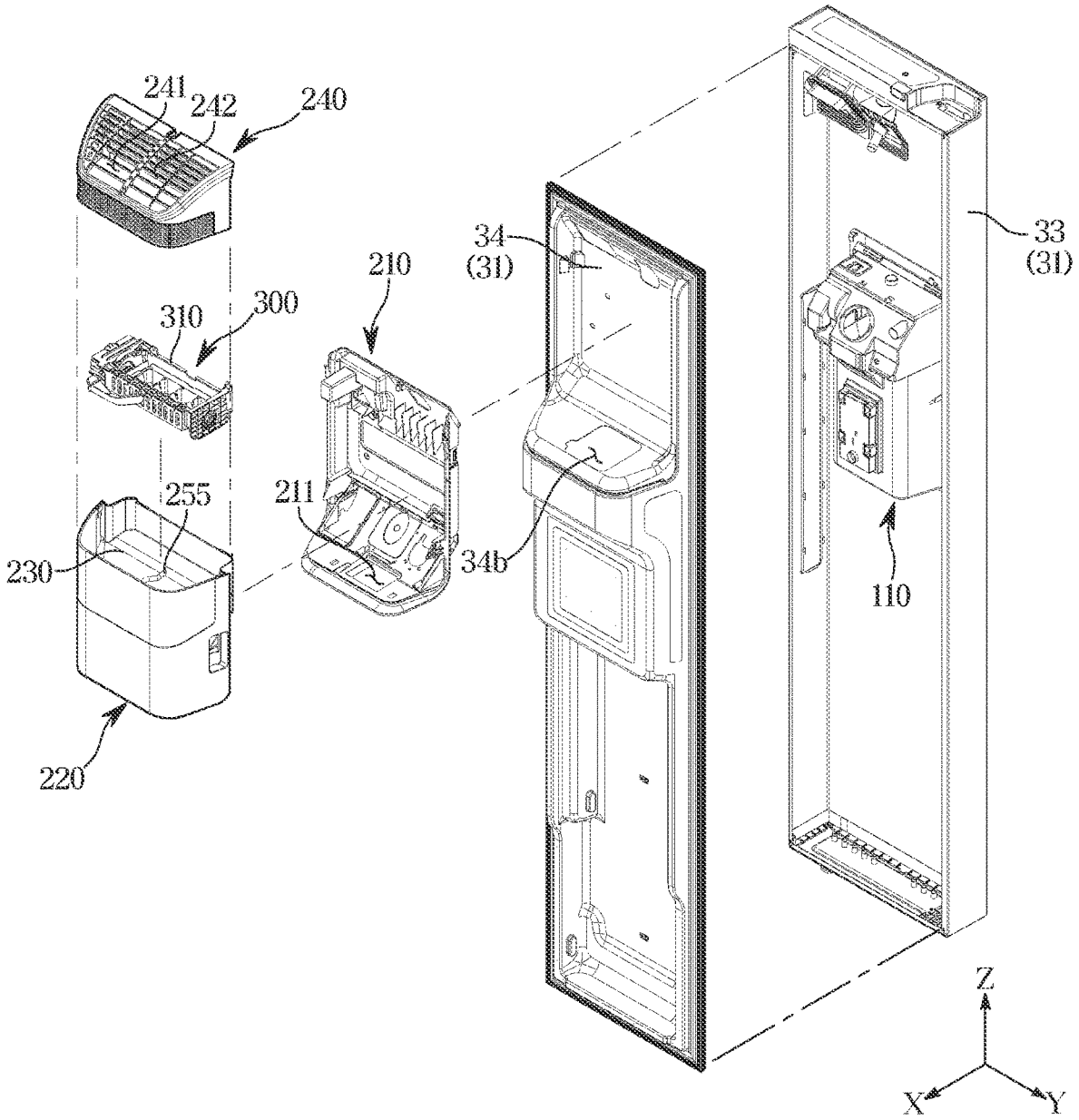
FIG. 5 is an exploded perspective view illustrating a freezing compartment door and the ice making chamber in the refrigerator according to various embodiments of the present disclosure.
Figure 6:
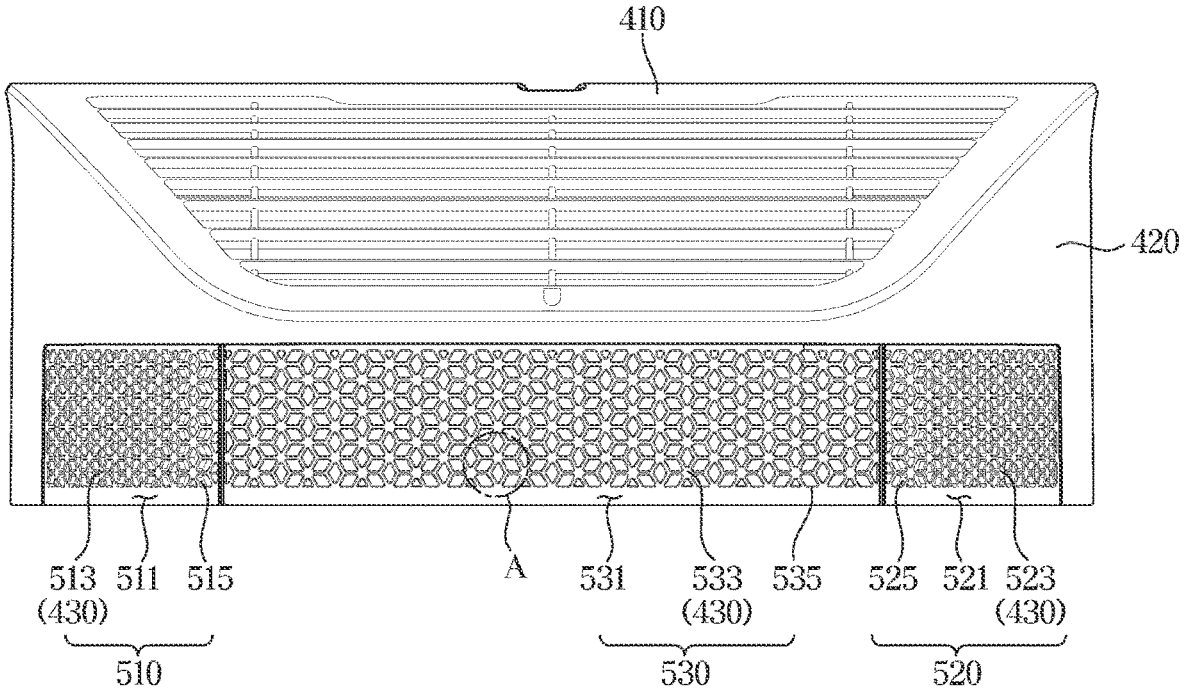
FIG. 6 is a perspective view illustrating an ice cover in the refrigerator according to various embodiments of the present disclosure.
Figure 7:
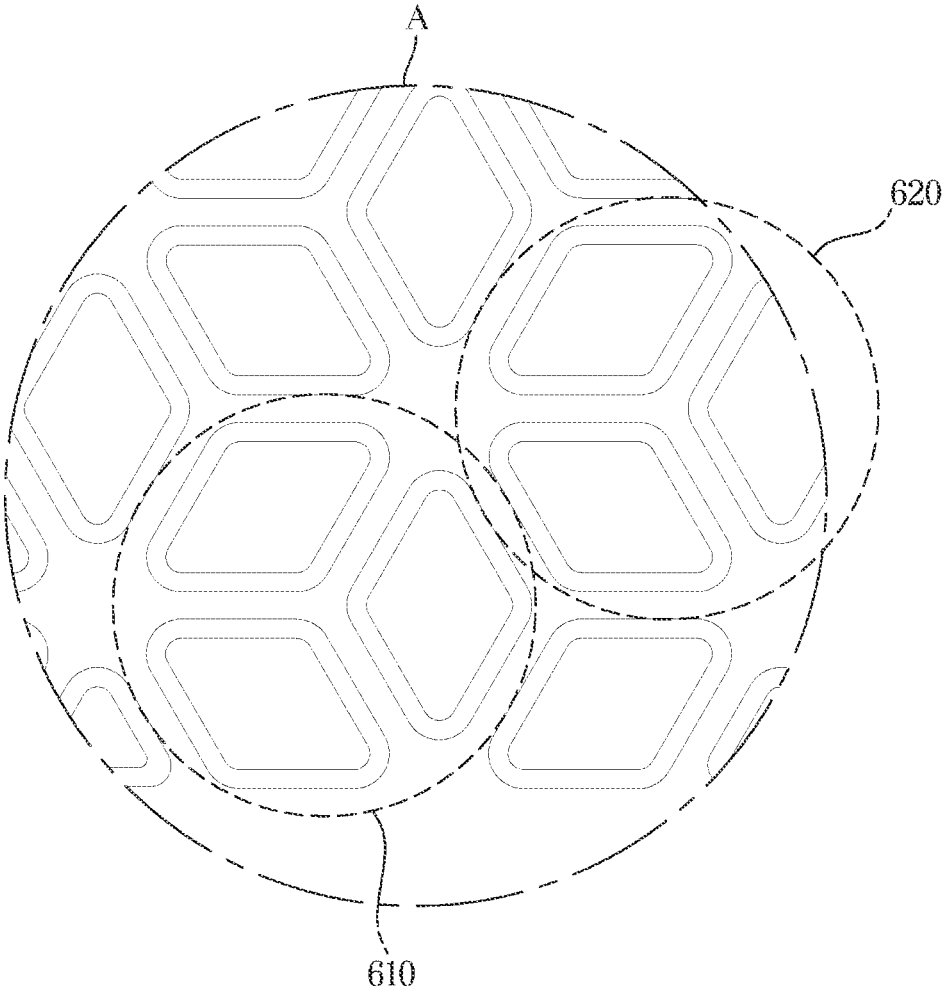
FIG. 7 is an enlarged view of a part 'A' in FIG. 6.

FIG. 1 is a perspective view of a refrigerator 1 according to an embodiment of the present disclosure, FIG. 2 is a view illustrating a state in which a freezing compartment door 31 is opened in the refrigerator 1 according to an embodiment of the present disclosure, FIG. 3 is a cross-sectional view of the refrigerator 1 taken along line C-C' in FIG. 1 FIG. 4 is a perspective view illustrating an ice making chamber 200 in the refrigerator 1 according to an embodiment of the present disclosure, FIG. 5 is an exploded perspective view illustrating a freezing compartment door 31 and the ice making chamber 200 in the refrigerator 1 according to an embodiment of the present disclosure, FIG. 6 is a perspective view illustrating an ice cover 240 in the refrigerator 1 according to an embodiment of the present disclosure, and FIG. 7 is an enlarged view of a part 'A' in FIG. 6.

As illustrated in FIGS. 1 to 5, a refrigerator 1 may include a main body 10. The main body 10 may include an inner case 11 defining a storage compartment 20. The inner case 11 may include an upper wall 11*a*, a lower wall 11*b*, a right wall, a left wall 11*d*, and a rear wall 11*e*. The main body 10 may further include an outer case 12 coupled to an outer side of the inner case 11. The outer case 12 may be coupled to the outer side of the inner case 11 to form an exterior of the refrigerator 1. The main body 10 may further include an insulator 13 between the inner case 11 and the outer case 12 to insulate the storage compartment 20. The inner case 11 may be formed by injection of a plastic material, and the outer case 12 may be formed of a metal material. As the insulator 13, a urethane foam insulator (urethane foam insulation) may be used, and a vacuum insulator (vacuum insulation panel) may be used together as needed.

The refrigerator 1 may further include a storage compartment 20 formed in the inner case 11. The storage compartment 20 may include an open front surface so that food may be put in and out therethrough. The storage compartment 20 may include a refrigerating compartment 22 and a freezing compartment 21. As an example, a storage compartment on the right may be used as the refrigerating compartment 22 maintained at about 0 to 5 degrees Celsius to store food in a refrigerated state, and a storage compartment on the left may be used as the freezing compartment maintained at about −30 to 0 degrees Celsius to store food in a frozen state.

In the storage compartment 20, shelves on which food may be placed and drawers drawn out from or inserted into the storage compartment 20 in a sliding manner may be included. The shelves may be supported on support bars 28 formed on a right wall and a left wall 11*d* of the inner case 11, respectively, and the drawers may be slidably coupled to guide rails 29 formed on the right wall and the left wall 11*d*, respectively.

The refrigerator 1 may further include a door 30 to open and close the storage compartment 20. The door 30 may be provided in front of the storage compartment 20. Specifically, the door 30 may be rotatably provided to open and close the open front surface of the storage compartment 20. The door 30 may include a refrigerating compartment door 32 to open and close the refrigerating compartment 22, and a freezing compartment door 31 to open and close the freezing compartment 21. The refrigerating compartment door 32 may be rotatably coupled to the main body 10 to open and close the refrigerating compartment 22, and the freezing compartment door 31 may be rotatably coupled to the main body 10 to open and close the freezing compartment 21. The refrigerating compartment door 32 and the freezing compartment door 31 may be rotatably coupled to the main body 10 by hinge members 40, respectively.

The door 30 may include a front plate 33 and a rear plate 34 coupled to a rear surface of the front plate 33. The front plate 33 of the door 30 may form the exterior of the refrigerator 1 together with the outer case 12 of the main body 10. Specifically, the front plate 33 of the door 30 may form a front exterior of the refrigerator 1. The rear plate 34 of the door 30 may define a rear surface of the door 30. The door 30 may further include an insulator 35 between the front plate 33 and the rear plate 34. As the insulator 35, like the insulator 13 of the main body 10, a urethane foam insulator (urethane foam insulation) may be used, and a vacuum insulator (vacuum insulation panel) may be used together as needed. An ice making chamber 200 may be insulated by the insulator 35 of the door 30.

A gasket 36 may be provided on the rear surface of the door 30 to be in close contact with the front surface of the main body 10 to seal the storage compartment 20.

The refrigerator 1 may further include the ice making chamber 200 in the door 30. The ice making chamber 200 may be provided on the rear surface of the door 30. A detailed description of the ice making chamber 200 will be given later.

The refrigerator 1 may further include a cold air supply device to supply cold air to the storage compartment 20 and the ice making chamber 200. The cold air supply device may generate cold air using latent heat of evaporation of a refrigerant. The cold air supply device may include an evaporator, a compressor, a condenser, and an expansion device. The cold air generated in the evaporator may be supplied to the storage compartment 20 and the ice making chamber 200 by an operation of a blowing fan 150.

The refrigerator 1 may further include a cold air supply duct 50 in which the cold air supply device is accommodated. The cold air supply duct 50 may be defined by the rear wall 11*e* of the inner case 11 and a duct cover 60. That is, the duct cover 60 may be coupled to the rear wall 11*e* of the inner case 11 to form the cold air supply duct 50 in which the cold air supply device is accommodated. A rear wall of the storage compartment 20 may be formed by the duct cover 60. A left wall, a right wall, an upper wall, and a lower wall of the storage compartment 20 are formed by the left wall 11*d*, the right wall 11*c*, the upper wall 11*a* and the lower wall 11*b* of the inner case 11, respectively.

The refrigerator 1 may further include a cold air inlet 70 provided such that the cold air generated in the cold air supply device is introduced into the storage compartment 20. The cold air inlet 70 may be formed on the duct cover 60. The cold air supply duct 50 and the storage compartment 20 may communicate with each other by the cold air inlet 70. Suitably, the refrigerator 1 may include a plurality of the cold air inlets 70. The plurality of cold air inlets 70 may include a first cold air inlet 71 positioned at the uppermost end in a vertical direction Z of the refrigerator 1, and a plurality of second cold air inlets 72 positioned below the first cold air inlet 71 in the vertical direction Z of the refrigerator 1. The cold air introduced into the storage compartment 20 through the first cold air inlet 71 may be introduced into the ice making chamber 200. The first cold air inlet 71 may be formed on the duct cover 60 to be adjacent to the upper wall 11*a* of the inner case 11.

The duct cover 60 may include a protrusion 73 protruding toward the storage compartment 20. The cold air generated in the cold air supply device may move along a guide surface 74 of the protrusion 73 facing the rear wall 11*e* of the inner case 11 and be introduced into the storage compartment 20 through the first cold air inlet 71. The first cold air inlet 71 may be positioned above the protrusion 73. The guide surface 74 may include a first section protruding in an inner direction of the storage compartment 20 with respect to the duct cover 60, and a second section extending from the first section to be substantially parallel to the duct cover 60. The cold air generated in the cold air supply device may pass through the first section and the second section of the guide surface 74 sequentially and be introduced into the storage compartment 20 through the first cold air inlet 71. The cold air introduced into the storage compartment 20 through the cold air inlet 70 may increase in temperature through heat exchange in a process of circulating the ice making chamber 200 and the storage compartment 20 and may be discharged into the cold air supply duct 50 through an outlet. The outlet may be formed on the duct cover 60. Suitably, the outlet may be formed on the duct cover 60 to be positioned below the cold air inlet 70 in the vertical direction Z of the refrigerator 1. The outlet may have a grill shape. However, the shape of the outlet is not limited to the above example and may be variously changed.

The refrigerator 1 may further include a dispenser 110 to provide water and ice to a user. The dispenser 110 may be provided in the freezing compartment door 31. The dispenser 110 may include a dispensing space 111 formed to be recessed to receive water and ice, a dispensing tray 112 disposed in the dispensing space 111 to allow a container such as a cup to be placed thereon, and a dispensing switch 113 capable of inputting an operation command of the dispenser 110.

The ice making chamber 200 may further include an ice bucket 220 coupled to at least one of an ice making frame 210 and the rear plate 34 of the door 30 such that a predetermined space is provided therein. Suitably, the ice bucket 220 may be coupled to the ice making frame 210 such that the predetermined space is provided therein.

The ice making chamber 200 may further include an ice cover 240 coupled to at least one of the ice making frame 210 and the rear plate 34 of the door 30 to be positioned above the ice bucket 220. Suitably, the ice cover 240 may be coupled to the ice making frame 210 to be positioned above the ice bucket 220. The ice cover 240 may be positioned above the ice bucket 220 to be spaced apart from the ice bucket 220 in the vertical direction Z of the refrigerator 1. That is, a lower end of the ice cover 240 may be spaced apart from an upper end of the ice bucket 220 in the vertical direction Z of the refrigerator 1. The cold air introduced into the ice making chamber 200 may flow out into the storage compartment 20 through a gap between the ice cover 240 and the ice bucket 220. In other words, the ice cover 240 may be spaced apart from the ice bucket 220 in the vertical direction Z of the refrigerator 1 to define a cold air outlet 500.

The cold air introduced into the ice making chamber 200 may be circulated by being discharged into the storage compartment 20 through the cold air outlet 500.

The ice cover 240 may form an exterior of the ice making chamber 200 together with the ice bucket 220. That is, the ice cover 240 may form the exterior of the ice making chamber 200 exposed to the outside of the main body 10 together with the ice bucket 220 when the door 30 is opened.

The ice cover 240 may include a first part 410 and a second part 420 extending downward from a circumference of the first part 410.

The first part 410 may include a plurality of cold air inlet slits 241 provided such that cold air moving along the upper wall 11*a* of the inner case 11 is introduced into the ice making chamber 200. The first part 410 may further include a plurality of partition ribs 242 to partition the plurality of cold air inlet slits 241. The cold air passed through the plurality of cold air inlet slits 241 may be discharged to the cold air outlet 500 through the ice making space 251.

In this case, the first part 410 is inclined downward in a direction to the inside of the freezing compartment 21 from the door 30, and the plurality of partition ribs 242 may also be disposed to be inclined downward on the first part 410 in the direction to the inside of the freezing compartment 21 from the door 30.

The second part 420 of the ice cover 240 will be described later.

The cold air introduced into the ice making space 251 through the cold air inlet slits 241 is mainly transferred to water stored in an ice tray 310.

The ice making chamber 200 may further include an inner space 250 defined by the ice making frame 210, the ice cover 240, and the ice bucket 220. The inner space 250 may include an ice making space 251 in which ice is generated and stored, and an ice moving space 252 positioned below the ice making space 251 in the vertical direction Z of the refrigerator 1. Ice generated by the ice maker 300 may be collected at a bottom of the ice making space 251 and stored in the ice making space 251. The inner space 250 may be divided into the ice making space 251 and the ice moving space 252 by a partition plate 230. A discharge opening may be formed on the partition plate 230 to allow the ice generated in the ice making space 251 to move to the ice moving space 252. The ice moving space 252 may be defined by the ice bucket 220, the partition plate 230, and the ice making frame 210. Assuming that the ice bucket 220 defines a front wall and opposite side walls of the ice moving space 252, the ice making frame 210 may define a rear wall and a lower wall of the ice moving space 252, and the partition plate 230 may define an upper wall of the ice moving space 252.

An opening 211 may be formed on a portion of the ice making frame 210 defining the lower wall of the ice moving space 252 to discharge ice inside the ice moving space 252. The ice discharged from the ice moving space 252 may be moved to the dispensing space 111 through a chute 115. Specifically, the ice passed through the opening 211 and an opening 34*b* formed on the rear plate 34 of the door 30 to correspond to the opening 211 sequentially may be moved to the dispensing space 111 through the chute 115.

A transfer member 255 rotatably provided to stir and transfer ice and a crushing blade 256 to crush ice may be disposed in the ice moving space 252. The transfer member 255 may be operated by being connected to a transfer motor 257. A portion of the transfer member 255 may pass through the discharge opening of the partition plate 230 to be disposed in the ice making space 251.

The refrigerator 1 may further include an ice maker 300 disposed inside the ice making chamber 200. Specifically, the ice maker 300 may be disposed in the ice making space 251.

The ice maker 300 may include the ice tray 310 capable of storing water. The ice tray 310 may be formed of a plastic material. The water stored in the ice tray 310 may be cooled by cold air circulating through the ice making space 251.

The cold air cools the ice tray 310 and then is discharged to the outside of the ice cover 240 through the second part 420 of the ice cover 240. To this end, a plurality of cold air outlet slits 430 is provided in the second part 420.

More specifically, referring to FIG. 6, the second part 420 includes a first side surface 510, a second side surface 520, and a central surface 530.

The first side surface 510 includes a first opening 511, and a first cold air outlet slits 513 provided in the first opening 511, and a plurality of first ribs 515 to partition the first opening 511 to form the first cold air outlet slits 513. The first cold air outlet slits 513 may be provided by injection molding the first ribs 515 into the first opening 511.

The second side surface 520 includes a second opening 521, and second cold air outlet slits 523 provided in the second opening 521, and a plurality of second ribs 525 to partition the second opening 521 to form the second cold air outlet slits 523. The second cold air outlet slits 523 may be provided by injection molding the second ribs 525 into the second opening 521.

The central surface 530 includes a third opening 531, and third cold air outlet slits 533 provided in the third opening 531, and a plurality of third ribs 535 to partition the third opening 531 to form the third cold air outlet slits 533. The third cold air outlet slits 533 may be provided by injection molding the third ribs 535 into the third opening 531.

The plurality of cold air outlet slits 430 may be provided only in a portion of the second part 420. That is, the third ribs 535 may be provided throughout the third opening 531, the first ribs 515 may be provided in a portion of a lower side of the first opening 511, and the second ribs 525 may be provided in a portion of a lower side of the second opening 521. In this case, the reason for forming the first and second ribs 515 and 525 in the lower sides of the first and second openings 511 and 521, respectively, is to prevent cold air from being discharged through the cold air outlet slits 430 without cooling the ice tray because when the cold air outlet slits 430 are positioned relatively above the ice tray, the cold air may be discharged through the cold air outlet slits 430 without cooling the ice tray.

Referring to FIG. 7, each of the first to third ribs 515, 525, and 535 may include a first rib member 610 and a second rib member 620, which have a hexagonal cross section.

The second rib member 620 may be disposed parallel to the first rib member 610.

The first rib member 610 and the second rib member 620 may be alternately arranged along the extending direction of the second part 420.

The ice tray 310 may be positioned at a height corresponding to a lower end of the second part 420. Thus, after cooling a bottom surface of the ice tray 310, the cold air may be discharged through the cold air outlet 500, or may be easily discharged through the plurality of cold air outlet slits 430 positioned adjacent to the cold air outlet 500 above the cold air outlet 500.

A sum of an area of the cold air outlet 500 and an area of the plurality of cold air outlet slits 430 may be greater than an area of the cold air inlet 70. Accordingly, a flow rate of cold air to be discharged through the cold air outlet 500 and the cold air outlet slits 430 may increase, and the cold air introduced through the cold air inlet 70 may be easily discharged to the outside of the ice making chamber.

Figure 8:
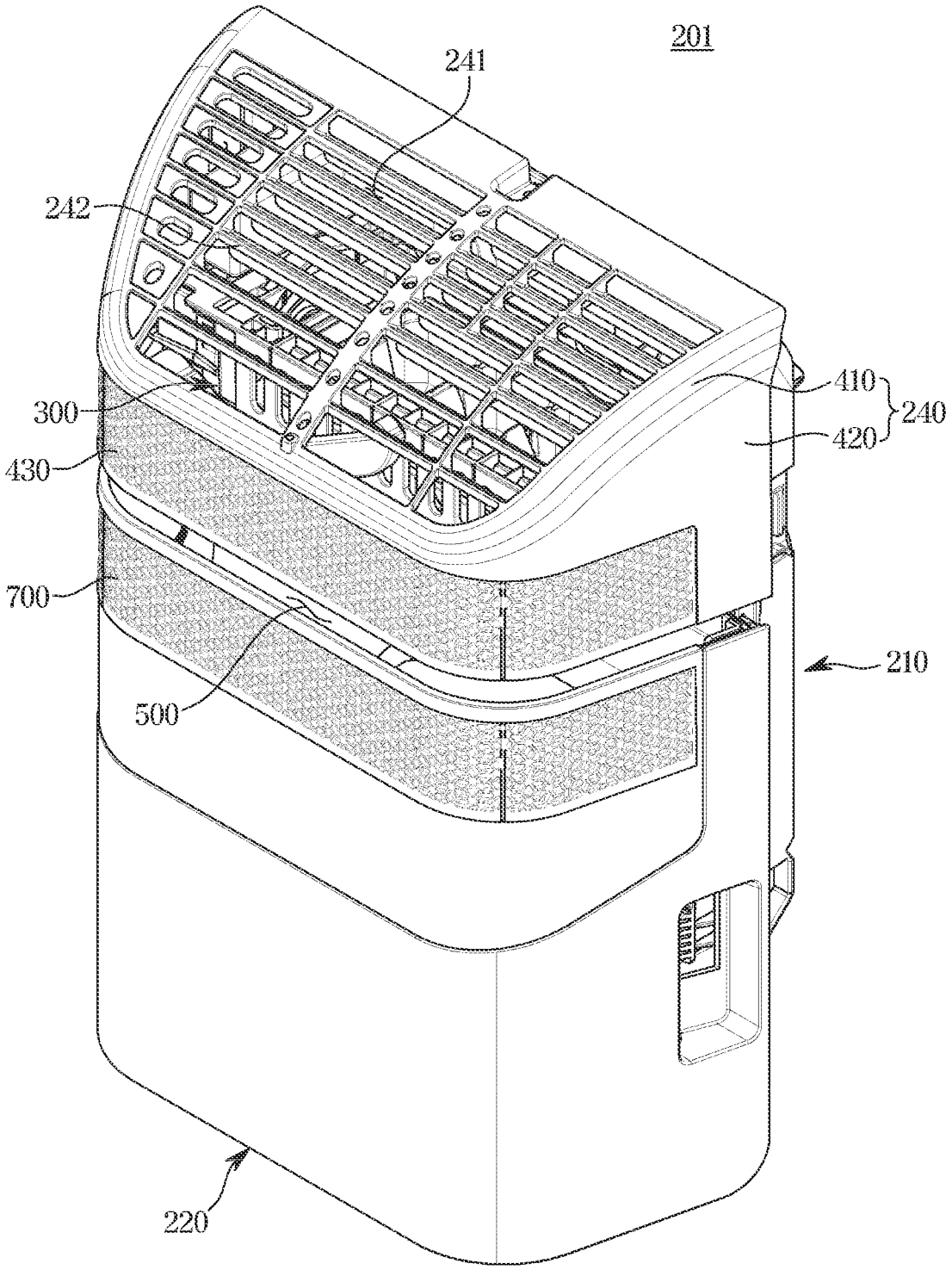
FIG. 8 is a perspective view illustrating an ice making chamber in a refrigerator according to various embodiments of the present disclosure.

FIG. 8 is a perspective view illustrating an ice making chamber in a refrigerator according to another embodiment of the present disclosure.

Guide slits 700 opened in the upper end of the ice bucket 220 may be provided in an ice making chamber 201 illustrated in FIG. 8. That is, the guide slits 700 may be provided in the upper end adjacent to the ice cover 240 of the ice bucket 220 to guide the discharge of cold air.

The cold air outlet slits 430 are provided in the second part 420, and the guide slits 700 are provided in the upper end of the ice bucket 220, so that discharge of the cold air that has cooled the ice tray may be performed more easily, and thus the flow rate of the cold air increases, so that the cooling efficiency of the ice tray may be improved.

The scope of the present disclosure is not limited to the specific embodiments described above. Various other embodiments that may be modified or deformed by those of ordinary skill in the art within the scope that does not deviate from the gist of the technical idea of the present disclosure specified in the claims may also belong to the scope of the present disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a cabinet comprising a freezing compartment and a heat exchange chamber configured to supply cold air to the freezing compartment;

a door configured to open and close the freezing compartment;

an ice making chamber provided on a rear surface of the door and comprising an ice maker configured to make ice;

an ice bucket provided below the ice maker such that the ice made by the ice maker is dropped and stored; and an ice cover configured to cover the ice maker and comprising:

a first part provided with a plurality of cold air inlet slits into which the cold air is introduced, and a second part extending downward from the first part and provided with a plurality of cold air outlet slits through which the cold air is discharged, and wherein a lower end of the ice cover is spaced apart from an upper end of the ice bucket to form a cold air outlet through which the cold air heat-exchanged in the ice maker is discharged, and wherein the cold air passed through the plurality of cold air inlet slits is discharged to the cold air outlet and the plurality of cold air outlet slits, wherein the second part comprises:

a first side surface forming a first side of the ice cover and comprising:

a first opening, first cold air outlet slits provided in the first opening, and first ribs configured to partition the first opening to form the first cold air outlet slits, a second side surface forming another side of the ice cover and comprising:

a second opening, second cold air outlet slits provided in the second opening, and second ribs configured to partition the second opening to form the second cold air outlet slits, and a central surface connecting the first side surface and the second side surface and comprising:

a third opening, third cold air outlet slits provided in the third opening, and third ribs configured to partition the third opening to form the third cold air outlet slits.

2. The refrigerator according to claim 1, wherein the first part further comprises a plurality of partition ribs configured to partition the plurality of cold air inlet slits, and is provided to be inclined downward in a direction to an inside of the freezing compartment from the door.

3. The refrigerator according to claim 2, wherein the second part is provided to extend downward from a circumference of the first part.

4. The refrigerator according to claim 3, wherein the plurality of cold air outlet slits is provided in a portion of the second part.

5. The refrigerator according to claim 1, wherein the first to third ribs are injection molded into the first to third openings, respectively.

6. The refrigerator according to claim 5, wherein:

the first ribs are provided in a portion of a lower side of the first opening, the second ribs are provided in a portion of a lower side of the second opening, and the third ribs are provided throughout the third opening.

7. The refrigerator according to claim 1, wherein:

the ice maker further comprises an ice tray positioned at a height corresponding to a lower end of the second part, and an upper end of the cold air outlet is positioned at a height corresponding to a bottom surface of the ice tray.

8. The refrigerator according to claim 7, wherein after the cold air cools the bottom surface of the ice tray, a first part of the cold air is discharged through the cold air outlet, and a second part of the cold air is moved upward and discharged through the plurality of cold air outlet slits.

9. The refrigerator according to claim 8, wherein a sum of an area of the cold air outlet and an area of the plurality of cold air outlet slits is greater than an area of a cold air inlet.

10. The refrigerator according to claim 1, wherein a guide slit opened to guide discharge of the cold air is provided at the upper end of the ice bucket adjacent to the ice cover.

11. The refrigerator according to claim 1, wherein each of the first to third ribs comprises:

a first rib member having a hexagonal cross section; and a second rib member having a hexagonal cross section and disposed in parallel with the first rib member so that an edge of the second rib member abuts against an edge of the first rib member.

12. The refrigerator according to claim 11, wherein the first and second rib members are alternately arranged along extending direction of the second part.

13. A refrigerator comprising:

a cabinet comprising a freezing compartment and a heat exchange chamber configured to supply cold air to the freezing compartment;

a door configured to open and close the freezing compartment;

an ice making chamber provided on a rear surface of the door and comprising an ice maker configured to make ice; and an ice cover configured to cover the ice maker and comprising:

a first part provided with a plurality of cold air inlet slits into which the cold air is introduced, and a second part extending downward from the first part and provided with a plurality of cold air outlet slits through which the cold air is discharged; and an ice bucket provided such that the ice made by the ice maker is dropped and stored and provided with a guide slit opened to guide discharge of the cold air at an upper end thereof, wherein the second part comprises:

a first side surface forming a first side of the ice cover and comprising:

a first opening, first cold air outlet slits provided in the first opening, and first ribs configured to partition the first opening to form the first cold air outlet slits;

a second side surface forming another side of the ice cover and comprising:

a second opening, second cold air outlet slits provided in the second opening, and second ribs configured to partition the second opening to form the second cold air outlet slits; and a central surface connecting the first side surface and the second side surface and comprising:

a third opening, third cold air outlet slits provided in the third opening, and third ribs provided to partition the third opening to form the third cold air outlet slits.

14. The refrigerator according to claim 13, wherein the first part further comprises a plurality of partition ribs configured to partition the plurality of cold air inlet slits, and is provided to be inclined downward in a direction to an inside of the freezing compartment from the door.

15. The refrigerator according to claim 14, wherein the second part is provided to extend downward from a circumference of the first part.

16. The refrigerator according to claim 15, wherein the plurality of cold air outlet slits is provided in a portion of the second part.

17. The refrigerator according to claim 13, wherein the first to third ribs are injection molded into the first to third openings, respectively.

* * * * *